United States Patent [19]

Boys

[11] 4,012,622

[45] Mar. 15, 1977

[54] METHOD AND APPARATUS FOR COUNTING SMALL PARTS

[75] Inventor: John T. Boys, Christchurch, New Zealand

[73] Assignee: Standard Pressed Steel Co., Jenkintown, Pa.

[22] Filed: Dec. 20, 1974

[21] Appl. No.: 534,601

Related U.S. Application Data

[63] Continuation-in-part of Ser. No. 352,764, April 19, 1973, abandoned.

[30] Foreign Application Priority Data

Apr. 20, 1972 United Kingdom ..... 18353/72

[52] U.S. Cl. ..... 235/92 PK; 235/92 PL; 235/92 R; 235/98 R

[51] Int. Cl.[2] ..... G06M 11/00

[58] Field of Search ..... 235/92 PK, 92 PL, 98 R, 235/98 A; 209/98, 106; 222/564

[56] References Cited

UNITED STATES PATENTS

| | | | |
|---|---|---|---|
| 2,632,588 | 3/1953 | Hoar | 235/92 PK |
| 3,445,840 | 5/1969 | Carlstead | 235/92 PL |
| 3,748,446 | 7/1973 | Gass et al. | 235/92 PL |
| 3,789,194 | 1/1974 | Kirby | 235/92 PK |

*Primary Examiner*—Joseph M. Thesz
*Attorney, Agent, or Firm*—Andrew L. Ney; Aaron Nerenberg

[57] ABSTRACT

A method of counting small parts by feeding the parts in bulk to discharge a stream of parts into a separating region leading to a plurality of outlet channels, the separating region including spaced rods capable of spatially distributing the parts in a random manner over the outlet channels as the parts fall through the separating region and cascade from rod to rod, counting the number of parts passing through each outlet channel and adding together the corrected numbers of parts passing through all the channels.

21 Claims, 5 Drawing Figures

METHOD AND APPARATUS FOR COUNTING SMALL PARTS

Figure 1:
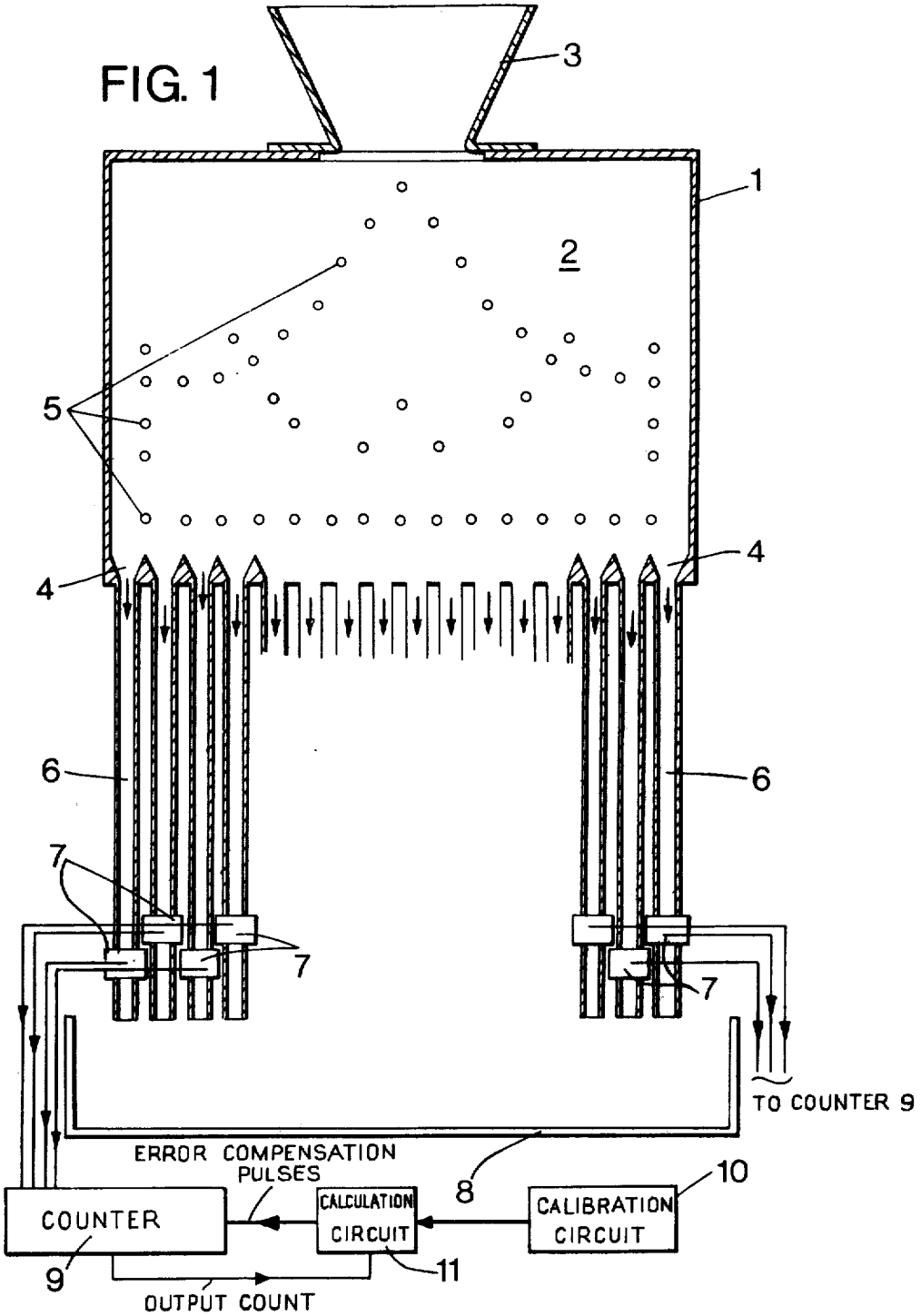

This application is a continuation-in-part of copending U.S. patent application Ser. No. 352,764 filed Apr. 19, 1973, now abandoned.

The invention relates to a method and apparatus for counting small parts, particularly, but not exclusively, small metal parts, such as screws, nuts and bolts.

Current commercially-available devices for counting metal parts require the parts to be ordered and presented to a detecting or counting head in sequence. Some parts (e.g. short socket set screws) are of such shapes that ordering and presenting is not, at present, feasible. Furthermore for most shapes of parts the pacticability of accurate counting is dependent on part size and the speed of counting is limited. An object of the invention is to provide a method of and apparatus for the counting of small parts at high speed (.e.g. up to 200 parts per second) and with a high degree of accuracy.

According to the invention, a method of counting small parts comprises feeding the parts in bulk to discharge a stream of parts into a separating region leading to a plurality of outlet channels, the separating region including distributing means capable of spatially distributing the parts in a random manner over the outlet channels, whereby parts will pass through each outlet channel, counting the number of parts passing through each outlet channel and adding together the corrected numbers of parts passing through all the channels.

Preferably the parts after entering the outlet channels are allowed to fall through a substantial distance before being counted, thereby to effect a temporal separation of the parts and therefore to increase the accuracy of counting of the numbers of parts in the streams of parts flowing through the respective outlet channels.

Conveniently the parts are counted by a sensing device in each channel, each sensing device sending a signal in response to each part sensed thereby to an adding device by which the total number of parts that have pssed through all the output channels is indicated.

A correction dependent upon the rate of flow of parts being counted and a predetermined calibration constant is fed into the adding device to continuously correct for the possibility of two or more parts passing through an outlet channel so closely together that the relevant sensing device is unable to distinguish between the parts.

Conveniently the distributing means many include members so positioned beneath the inlet to the separating region that the members are impinged by the parts falling through the separating region and are distributed by the members in a random manner over the outlet channels.

The invention also provides apparatus for performing the method of counting as set out hereinbefore, the apparatus comprising inlet means to which the parts are to be fed in bulk, a separating region positioned to receive parts passing through the inlet means, a plurality of outlet channels positioned side-by-side to receive parts from the separating region, distributing means in the separating region and capable of spatially distributing the parts in a random manner over the outlet channels and a sensing device associated with each outlet channel to determine the number of parts passing therethrough.

The distributing means are conveniently bars or wires extending substantially horizontally across the separating region at various heights above the outlet channels and so spaced apart and arranged as to cause the parts to be deflected in a cascading manner from one bar or wire to another as the parts fall through the separating region.

The separating region is conveniently of rectangular shape, as viewed in plan, the bars or wires extending substantially parallel with each other between at last one pair of opposite side wals of the separating region. Where the bars or wires extend between only one pair of opposite side walls of the separating region, the inlet means and the outlet channels may also extend between said one pair of opposite side walls; but where the bars or wires extend between both pairs of opposite side walls and form a grid, as viewed in plan, the hopper may be centrally positioned and the lower end of the separating region may be divided into outlet channels arranged side-by-side in both lateral dimensions.

The outlet channels may be tubular or inclined chutes each having a sensing device spaced at a substantial distance below the lower end of the separating region. The sensing devices are conveniently of an electrical kind, such as an inductive coil, but they may alternatively give other kinds of counting signals e.g. pneumatic, optical or ultrasonic signals.

By way of example, three forms of the apparatus for counting small parts of metal, e.g., screws, nuts or bolts are now described with reference to the accompanying diagrammatic drawings in which:-

Figure 2:
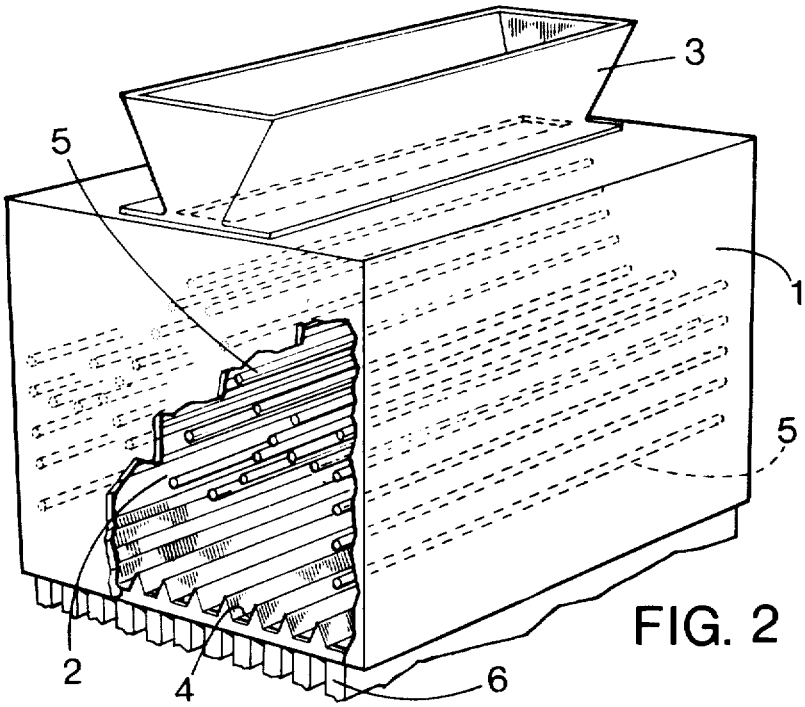
Figure 3:
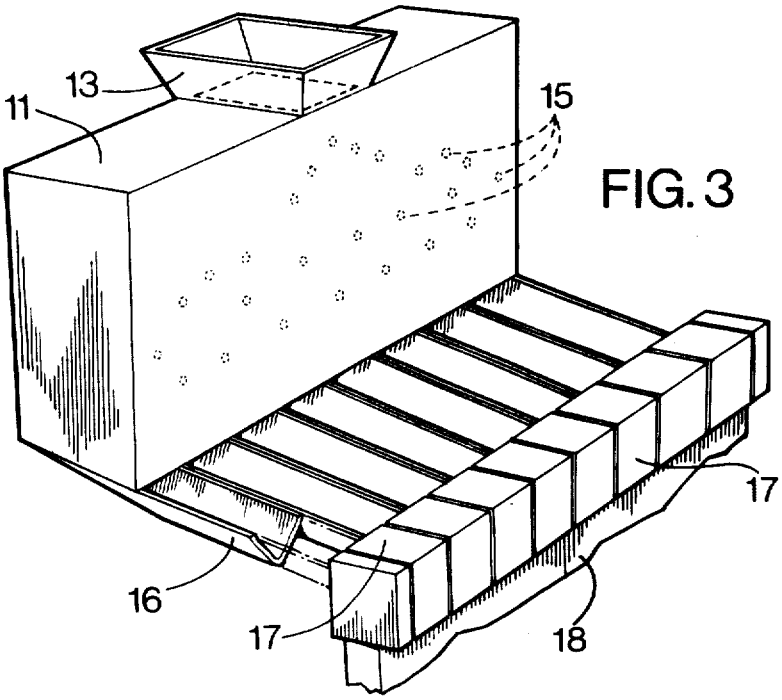
Figure 4:
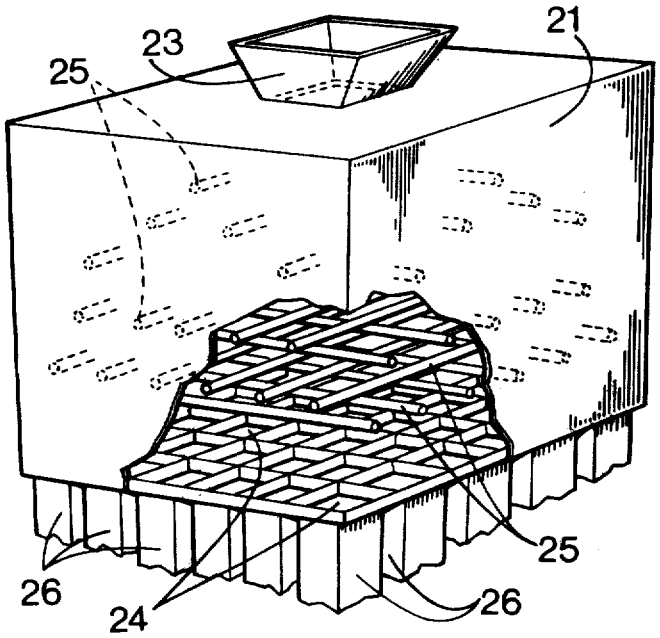
Figure 5:
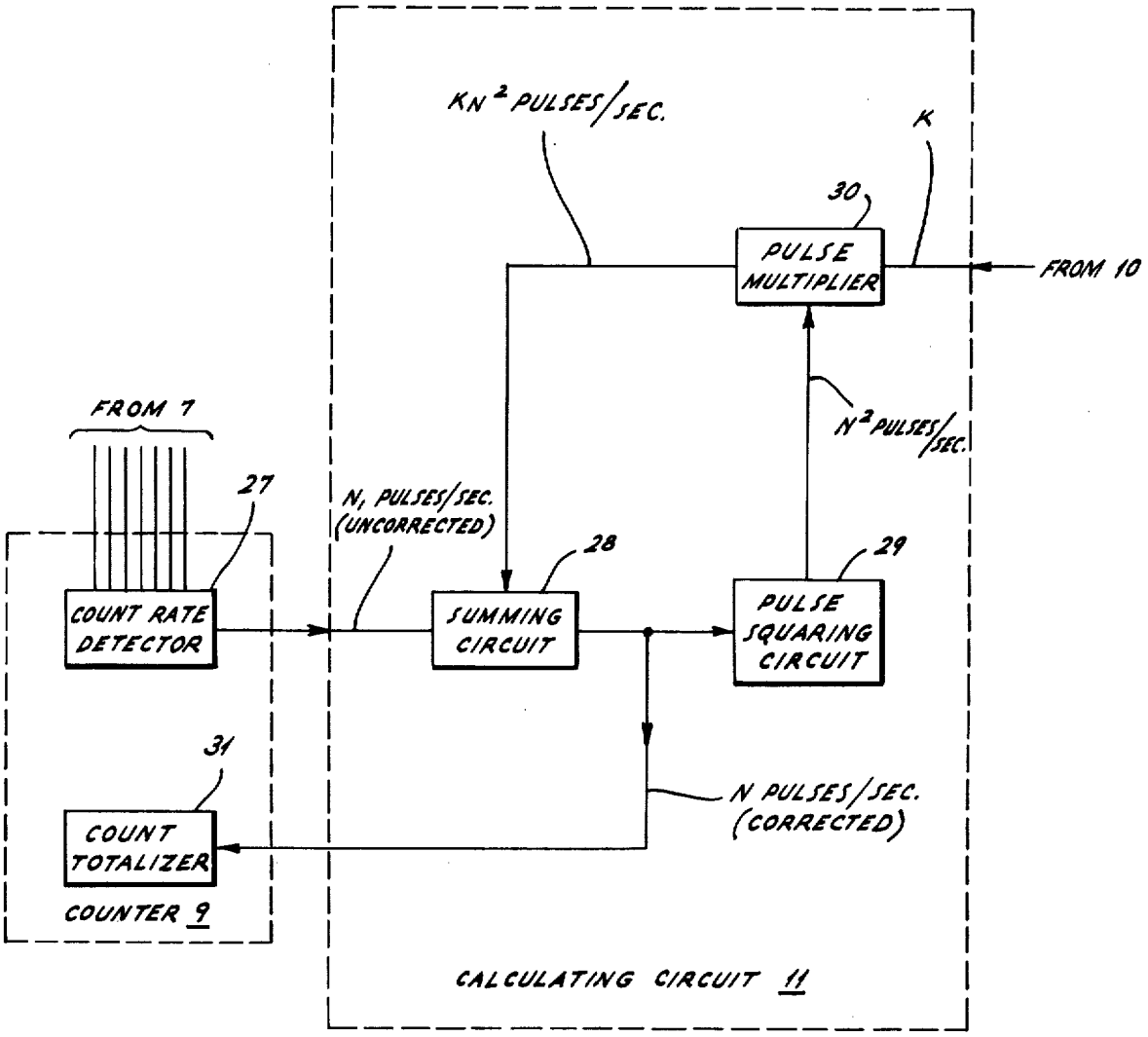

FIG. 1 is a vertical section through the first apparatus and also shows counting circuitry in block form, FIG. 2 is a perspective view of the separating region of the apparatus shown in FIG. 1, FIG. 3 is a perspective view of the separating and counting region of the second apparatus, FIG. 4 is a perspective view, similar to FIG. 2, of the separating region of the third apparatus, and FIG. 5 is a block diagram of the counter and calculating circuit of FIG. 1.

The apparatus shown in FIGS. 1 and 2 comprises a compartment 1 rectangular in plan defining a separating region 2. The upper end of the compartment is provided with a hopper 3 and the lower end of the compartment is provided with a plurality of outlet channels 4 arranged side-by-side across the compartment. The hopper 3 and the channels 4 run from the front to the back walls of the compartment. A plurality of bars 5 extend substantially horizontally across the compartment 1 from the front to the back walls thereof. The bars 5 are spaced apart both laterally and vetically in the compartment such that when the parts to be counted are poured in bulk through the hopper 3, the parts will fall in a cascading manner through the separating region 2 and be deflected from one bar 5 to another and will arrive at the outlet channels 4 in a purely random manner. The arrangement of the bars is chosen to result in substantially the same rate of flow through each channel, i.e., the distribution of parts across the lower end of the compartment 2 is substantially uniform and does not follow the usual probability curve. For $n$ output channels the probability of a specific part entering a specific output channel 4 is $1/n$. It has been found experimentally that the distribution obtained from such an arrangement can be made to be virtually independent of size of parts.

If the rate of feeding parts through the hopper 3 is, for example, 100 per second, the output rate for each channel is ($100/n$). If the number of channels n is made large enough, for example 100, the output rate per channel will be one per second, which is readily countable.

The outlet channels 4 communicate with tubes 6, each leading to a sensing device 7. The tubes 6, as shown in FIG. 2, extend along the whole length from front to back of each outlet channel 4; but alternatively a plurality of tubes arranged one behind another may replace each single tube 6. The latter tubes may be of square, rectangular, circular or other suitable cross-section. The parts are allowed to fall freely through the tube 6 for approximately one foot (approximately 30 cms.) from the output channels, so that they will attain a velocity of approximately 100 inches per second (approximately 2.5 metres/second). The sensing devices 7 are such that at that velocity parts spaced more than 1 inch (approximately 2.5 cms.) apart will be separately detected. The probability of two successive parts in a tube 6 being closer together at a channel flow rate of one part per second is only approximately 1%. Thus the parts can be detected and counted with considerable accuracy. The sensing devices 7 are preferably inductive coils, especially where the parts to be counted are metallic, or other devices capable of transmitting electrical signals, but may also be of a type that give pneumatic, optical or ultrasonic signals. The signals from each sensing device 7 are added together electronically and displayed by using a standard electronic adding unit or counter 9. The parts are collected together in a common receptacle 8.

With a substantially uniform distribution of parts flow through each outlet channel 4, the probability of a sensing device 7 detecting two or more parts as a single part can be accurately computed, and for a given apparatus the error to be added to the total indicated by counter 9 depends primarily on the flow rate of parts. Therefore, the inaccuracy in the number of parts sensed can be determined from measurements of the rate of flow, and allowance for the inaccuracy can be made by adding the error count to the sensed count with appropriate electronic circuitry. An error calibration is determined for the apparatus at different rates of flow. This error calibration is made once and is programmed into a calibration circuit 10, preferably an oscillator with a selectable period. Calibration circuit 10 is connected to a calculating circuit 11 which counts the output from counter 9 for the particular selected period and calculates an error signal which is proportional to the square of the count from counter 9 for the selected period and the error calibration previously programmed into calibration circuit 10. In this way an error compensation signal from circuit 11, which is being continuously modified by the count from counter 9, is continuously fed into the counter so that the total indicated by counter 9 always shows directly the corrected total.

Statistically it has been determined that the error in the count per second from counter 9 due to overlapping pieces, is proportional to the square of the total number of pieces counted during that second. Referring now to FIG. 5, an uncorrected flow signal, $N_1$ pulses/second, is fed from count rate detector 27 of counter 9 into a summing circuit 28, which has a second input of $KN^2$pulses/second. A corrected flow signal, N pulses/second is then fed to a pulse squaring circuit 29 which yields an output proportional to $N^2$ pulses/second. This output is in turn fed into a pulse multiplier circuit 30 which receives a second input from calibration circuit 10 of a preselected constant frequency K. Constant K is determined experimentally and is dependent on the geometry of both the parts being counted and tubes 6. Constant K may also include a fixed scaling factor, the application of which will be discussed more fully hereinafter in an example. After multiplicaton, the output $KN^2$ pulses/second is fed back into summing circuit 28 where it is added to the uncorrected flow signal, $N_1$ pulses/second to generate the corrected flow signal, N pulses/second. This corrected signal is fed back into count totalizer 31 of counter 9 to obtain a total corrected part count.

For example, suppose the calibration circuit 10 oscillator is set at 1 Hertz and the output pulses $N_1$ from counter 9 are being fed at a rate of 100/second. The scaling actually is 1/4096, so that the number of error compensation pulses $KN^2$ added per second in summing circuit 28 would be approximately 10,000/4096 $\cong$ 2.5%. This compensation is added to the uncorrected count $N_1$ in summing circuit 28 to provide the corrected count N to count totalizer 31 in counter 9. If the period of circuit 10 is increased to 2 seconds, for a new output pulse rate $N_1$ of 100 per second, the number of error compensation pulses N added per second would be 40,000/4096 $\cong$ 10%. This would be an extreme case, and this level of compensation has never been used. Thus by selecting the period of calibration circuit 10, appropriate compensation can be chosen to suit the particular items being counted. It should be noted that the error compensation needs no adjustment for a change in speed. That is to say, for a normal 100/second output pulse rate $N_1$ and 1 Hertz, a 2.5% error compensation factor would be used, while a flow rate of 200/second would cause the error compensation factor to rise to 10%. A flow rate of zero therefore results in zero compensation. While a scaling factor of 1/4096 has been disclosed for purposes of example, it should be understood that this value could vary and that the actual value of the scaling factor used is not essential to the invention described herein.

When parts being counted are standard hexagonal nuts or other near spherical parts, the tubes 6 are conveniently replaced by inclined chutes preferably of V-shaped cross-section and having a small fillet radius (e.g. ⅛ inches or 0.3 cms.) The nuts will then roll smoothly down the chutes which are conveniently inclined at approximately 20° to the horizontal and can be counted as ordered streams with substantially no error. By using the V-shaped chutes it has been found that a high feed rate of 200 per second and only 16 output channels will give an error of not more than 1% without compensation circuitry. FIG. 3 shows the second form of the apparatus which is intended to be used for counting hexagonal nuts or other parts which will roll. The apparatus comprises a separating compartment 11, similar to the compartment 1 in FIGS. 1 and 2 and including a similar arrangement of bars 15. The compartment 11 has a hopper 13 extending from front-to-back of the compartment. A plurality of outlet channels 14 into which the parts fall in a random manner, as described for FIGS. 1 and 2, lead to the same number of inclined V-section chutes 16 arranged side-by-side and are equivalent to the tubes 6 in FIGS. 1 and 2. Each chute 16 discharges the parts passing therethrough into a separate sensing device 17 similar to the sensing devices 7 in FIGS. 1 and 2. The parts are delivered from the sensing devices 17 through an outlet 18 which may be common to all the sensing devices 17 or there may be separate outlets 18 leading to a common collector. The sensing devices 17 count the parts passing therethrough and transmit signals to an adding unit 9, as shown in FIG. 1.

Non-metallic parts may be counted in the tubes 6 or chutes 16 by interruption of light to a light responsive device or by sensing devices resulting in ultrasonic or fluidics signals.

A larger number of outlet channels may be provided by arranging the hopper 3 at the centre of the upper end of the compartment 1 and by dividing the lower end of the compartment 1 into outlet channels arranged side-by-side both between the side walls, as shown in FIG. 1, and also the front and back walls of the compartment. Bars 5 are also arranged between the side walls in addition to the front and back walls to form a grid structure, as viewed in plan, the bars 5 being so arranged as to effect uniform distribution of parts over all the outlet channels. Such an arrangement is shown in FIG. 4 in which reference 21 shows the separating compartment containing a grid-like system of bars 25 of which some extend between the front and back walls of the compartment 21 and others extend between the side walls thereof. The upper end of the compartment 21 is provided with a centrally-positioned hopper 23. The lower end of the compartment is formed by a grid-like outlet plate defining a grid-like arrangement of outlet channels 24 arranged side-by-side and back-to-back over the whole area of the compartment 21. Each outlet channel leads separately to one of a plurality of tubes 26 each equivalent to a tube 6 of the apparatus shown in FIG. 1. Each tube 26 is provided with a sensing device such as 7 leading to an adding unit 9, as in FIG. 1. The tubes 26 may be of square, rectangular, circular or any other suitable cross-section to which the outlet channels are shaped to feed parts thereto.

Instead of employing the bars 5, 15 or 25 taut wires or other means may be used to produce the required cascading of the parts. Alternatively the parts could be distributed over the outlet channels in a manner other than cascading over bars or wires. For example, the parts could be fed by a hopper on to a vibrating conveyor or conveyors discharging the parts to the output channels.

The invention provides a method and apparatus for accurately counting parts which do not require active ordering of the parts, are not sensitive to size of the parts, and whose accuracy is obtained by using compensation circuitry based on statistical computations. The provision of the separating region which is a spatial randomising device, and the positioning of the sensing devices, enables parts to be fed in bulk but counted singly. The compensation circuitry enables the sensed count to be corrected in accordance with statistically determined factors.

I claim:

1. A method of counting small parts comprising feeding the parts in bulk to discharge a stream of parts into a separating region leading to a plurality of outlet channels, the separating region including distributing means for distributing the parts in a random manner over the outlet channels, whereby parts will pass through each outlet channel, counting the total uncorrected number of parts passing through each outlet channel, correcting for errors in the total uncorrected number of counting the number of parts passing through each outlet channel, wherein the correction is proportional to the square of the total uncorrected number of pieces counted and adding together the correction and the total uncorrected number of parts.

2. The method according to claim 1 in which the parts after entering the outlet channels are allowed to fall through a substantial distance before being counted.

3. The method according to claim 2 in which each of the parts is detected by a sensing device in each channel, each sensing device in each channel, each sensing device sending a signal in response to each part detected thereby to an adding device which indicates the total number of parts that have passed through all of the output channels.

4. The method according to claim 3 in which the correction is dependent upon the rate of flow of parts being counted and a predetermined calibration constant is fed into the correction device to correct for the possibility of a plurality of parts passing through each of the outlet channels so closely together that the sensing devices are unable to detect the passage of individual parts.

5. The method according to claim 1 in which the distributing means includes members positioned beneath the inlet to the separating region whereby the members are impinged upon by the parts falling through the separating region and are distributed by the members in a random manner over the outlet channels.

6. The method according to claim 1 wherein the total uncorrected number of parts counted is corrected by first raising said total uncorrected number of parts to a power of a predetermined fixed amount, secondly multiplying said first product by a second fixed amount including a fixed scaling factor, and summing the total uncorrected number of parts and the product of said second multiplication to provide the corrected number of parts passing through all of the output channels.

7. The method according to claim 6 wherein the uncorrected number of parts counted in all of the outlet channels is squared in said first multiplication.

8. Apparatus for counting parts comprising a separating compartment including inlet means through which parts are fed to said separating compartment and outlet means through which parts are discharged from said separating compartment, said outlet means comprising a plurality of channels positioned side-by-side, each channel including sensing means for detecting the number of parts passing therethrough, said separating compartment further including distributing means for distributing the parts in a random manner through said channels, means for determining the total uncorrected number of parts detected in all of said channels, correction means for calculating a correction of the total uncorrected number of parts based upon statistical probability calculations wherein the correction is proportional to the square of the total uncorrected number of parts detected, and counting means for counting the total corrected number of parts passing through all of said channels.

9. Apparatus in accordance with claim 8 wherein each of said sensing means is positioned a substantial distance from said separating compartment whereby the parts passing through each channel are allowed to move through a substantial distance before being detected.

10. Apparatus in accordance with claim 8 of said wherein each sensing means is positioned at least 30 centimeters from said separating compartment whereby the parts passing through each channel are allowed to fall through a substantial distance before being detected.

11. Apparatus in accordance with claim 8 wherein each of said sensing means is operative to send a signal to said determining means in response to each part being detected thereby, and wherein said correction means includes summing means, the signals indicative of the correction and the total uncorrected number of parts each being operatively fed to said summing means, the output signal from said summing means being operatively fed to said counting means including indicating means for displaying the total corrected number of parts.

12. Apparatus in accordance with claim 11 wherein the correction signal being dependent upon the rate of flow of parts is counted and a predetermined calibration constant to correct for the possibility of individual parts passing through a channel so closely together that said associated sensing means thereof is unable to detect the individual parts.

13. Apparatus in accordance with claim 8 wherein said distributing means comprises a plurality of deflecting elements.

14. Apparatus as claimed in claim 8 in which each said channel is tubular.

15. Apparatus as claimed in claim 8 in which each said channel is an inclined chute.

16. Apparatus in accordance with claim 8 wherein said correction means includes calculating means and calibration means, said calculating means including summing means responsive to the output signals from said sensing means, first signal multiplying means responsive to the output signal from said summing means, and second signal multiplying means responsive to the output signal from said first multiplying means and the output signal from said calibration means for multiplying said signals together, said second multiplying means output signal being operatively fed to said summing means wherein said sensing means output signals are corrected.

17. Apparatus in accordance with claim 16 wherein said calibration means includes a fixed scaling factor which is multiplied by said first signal multiplying means output signal to provide a correction signal which is added to said sensing means output signals in aid summing means.

18. Apparatus in accordance with claim 17 wherein said first multiplying means is operative to square said summing means output signal.

19. Apparatus for counting small parts comprising inlet means to which the parts are to be fed in bulk, a separating region positioned to receive parts passing through the inlet means, a plurality of outlet channels positioned side-by-side to receive parts from said separating region, distributing means in said separating region capable of distributing the parts in a random manner over said outlet channels, said distributing means comprising a plurality of bars extending substantially horizontally across the separating region at various heights above said outlet channels and so spaced apart and arranged as to cause the parts to be deflected in a cascading manner from one bar to another as the parts fall through the separating region and a sensing device associated with each said outlet channel to determine the number of parts passing therethrough.

20. Apparatus as claimed in claim 19 in which the separating region is of rectangular shape, as viewed in plan, the bars or wires extending substantially parallel with each other between a pair of opposite side walls of the separating region.

21. Apparatus as claimed in claim 20 in which the bars extend between both pairs of opposite side walls of the separating region to form a grid, as viewed in plan, the inlet means being centrally positioned and the lower end of the separating region being divided into outlet channels arranged side-by-side in both lateral dimensions.

* * * * *